United States Patent [19]

Schneider

[11] 4,044,966

[45] Aug. 30, 1977

[54] TAKE-UP FRAME FOR PILE FABRIC

[75] Inventor: Axel Schneider, Krefeld, Germany

[73] Assignee: Scheibler Peltzer & Co., Krefeld, Germany

[21] Appl. No.: 546,132

[22] Filed: Jan. 31, 1975

[30] Foreign Application Priority Data

Feb. 22, 1974 Germany ..... 2408590

[51] Int. Cl.[2] ..... B65D 85/671; B65H 75/02

[52] U.S. Cl. ..... 242/77.1; 206/389; 242/62

[58] Field of Search ..... 242/62, 77.1; 206/49, 206/389, 408

[56] References Cited

U.S. PATENT DOCUMENTS

| | | | |
|---|---|---|---|
| 2,315,532 | 4/1943 | Lucia et al. | 242/77.1 X |
| 2,342,668 | 2/1944 | Hellyar | 242/77.1 |
| 2,356,787 | 8/1944 | Hellyar | 242/77.1 |
| 2,831,641 | 4/1958 | Hart | 242/77.1 UX |
| 3,272,449 | 9/1966 | Schwartz | 242/62 |

*Primary Examiner*—Stanley N. Gilreath
*Assistant Examiner*—John M. Jillions
*Attorney, Agent, or Firm*—Herbert E. Kidder

[57] ABSTRACT

A take-up frame for pile fabric comprising two suspension frames disposed at the ends of a shaft in accordance with the width of fabric webs to be taken up and provided with hook bands which extend radially and into which the fabric webs are hooked, wherein the suspension frames are constructed of plastics material or the like and are provided with guideways in which hook bands of metal are disposed.

2 Claims, 12 Drawing Figures

TAKE-UP FRAME FOR PILE FABRIC

This invention relates to a take-up frame for pile fabric.

A take-up frame for pile fabric is known which has two suspension frames disposed at the end of a shaft in accordance with the width of fabric webs which are to be taken up and provided with hook bands which extend in the radial direction. The fabric webs are spirally coiled onto such take-up frames by attaching the side edges on the hook bands so that a substantial quantity of material web can be accommodated in a relatively limited space without causing the fabric surfaces to be in contact with each other.

It is known to construct the shaft of the take-up frame from timber board, the suspension frames, constructed either whooly of metal or whooly of plastics, being mounted on the ends of the timber board. A later development of a plastics take-up frame offers the advantage of lower weight and less costly manufacture but also suffers from serious disadvantages in practical handling, namely that it is not possible for the hook spikes to be made as sharp as those of the metal suspension frames, so that the needling process, which is still manually performed and is therefore time-consuming, is additionally rendered more difficult and slowed down.

The present invention provides a take-up frame for pile fabric comprising two suspension frames disposed at the ends of a shaft in accordance with the width of fabric webs to be taken up and provided with hook bands which extend radially and into which the fabric webs are hooked, wherein the suspension frames are constructed of plastics material or the like and are provided with guideways in which hook bands of metal are disposed.

The guideways are preferably constructed as slots.

The inwardly orientated end of at least one hook band of a suspension frame may project into the shaft to function as locking means. A positive connection between the shaft and suspension frame is thus produced through the hook band which is guided in the slot of the suspension frame but without the need for fastening elements such as screw fasteners.

At least one hook band of each suspension frame may be arranged to be radially movable in its guideway. To this end it is also advantageous if the inwardly orientated ends of the radially movable hook bands are constructed in pointed form and if the shaft is constructed of material which can be notched for example cardboard. Each of the radially movable hook bands may be provided with a guide slot inclined at an angle with respect to the shaft and a bolt mounted in the suspension frame engaging in the guide slot. Owing to the movable arrangement of the hook bands they are thrust inwardly to the shaft by the pull which is applied when the material web is needled so that the inwardly orientated spikes of the hook bands penetrate into the shaft which is constructed to this end of material which can be notched to enable a positive connection to be established.

The hook bands may comprise individual hooks arranged in series in the radial direction but which are detachably connected to each other and are individually movable towards the oppositely disposed suspension frame. The subdivision of the hook bands into individual hooks which are detachably connected to each other enables only those hooks which are required for the needling to be moved by a suitable device towards the opposite suspension frame in such a way that they project sufficiently from the quideways to enable the side edges of the material webs to hook into them while the hooks which are located further to the outside in the radial direction are situated sufficiently deeply in their guideways to prevent the tangentially incoming material webs becoming hooked upon them. This arrangement enables the needling process to be mechanically performed. The hooks may be suitably joined to each other by means of adhesive substance or adhesive tape.

The hooks may be slidable in the axial direction or alternatively the hooks may be arranged at an angle in their guideways with the hooked ends pointing outwardly and arranged to be pivotable outwardly in the direction of the shaft.

A retaining plate which is movable in the radial direction may be provided upstream of the hooked ends and in adddition the rear ends of the hooks may be bent, the bent parts being broader than the slot. These two features are intended to ensure that the hooks do not drop out of their guideways and that the hook which is to be advanced or pivoted out can be detached from those still connected to it and blocked by the retaining plate.

The slots which function as guideways may be constructed as grooves with a L-shaped undercut, the front or leading part of each hook projecting from the groove. Guideways constructed in this way ensure much improved stability for the suspension frame because its rear side remains imperforate.

The hook of at least one hook band situated nearest the shaft may have a spike which is orientated towards the shaft and projects therein when the hook is in the outward pivoted position. A positive connection between the suspension frame and the shaft is made possible by this arrangement.

At the position at which the suspension frames are located, the shaft may be provided with thickened portions which are preferably formed by adhesive tape coiled around the shaft.

The insides of the hubs of the suspension frames may be conically flared towards the oppositely disposed suspension frame. Preferably only part of the inside of the hub is conically flared, this part being adjoined by a part of the hub which is cylindrical. The cylindrical part of the inside of the hub may comprise two shouldered cylindrical sections of different diameter, the cylindrical section adjoining the conically flared part having the larger diameter. A hub constructed in this manner enables the suspension frame to be slid onto the thickened portion of the shaft to ensure reliable clamping of both parts.

Locking parts against which the ends of the shaft can be placed may be integrally formed on the outer ends of the hubs cross-section.

The invention will be further described, by way of example only, with reference to the accompanying drawings, in which.

Throughout the drawings, like reference numerals indicate like parts.

Figure 1:
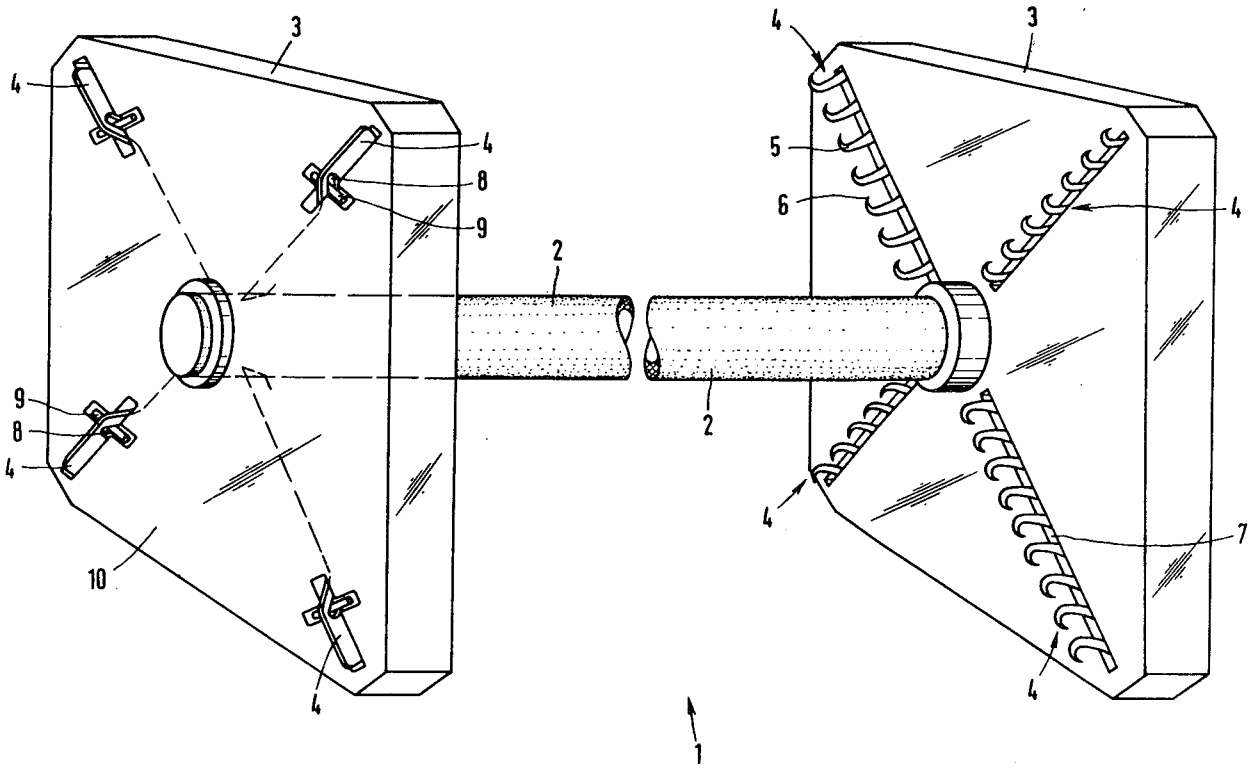
FIG. 1 is a perspective view of a take-up frame with undivided hook bands.

FIG. 1 shows a take-up frame 1 with a cylindrical shaft 2 of cardboard and two block-shaped suspension frames 3 of plastics material mounted at the end of the shaft. Each of the suspension frames contains four continuous hook bands 4 of metal situated in slots 7 disposed in a star-like pattern and each comprising a row of hooks 5 with radially outwardly pointing hooked ends 6. The hook bands 4 are each connected to the respective suspension frame 3 through a guide slot 8 which supports a bolt 9 at the rear side 10 of the suspension frame.

Figure 2:
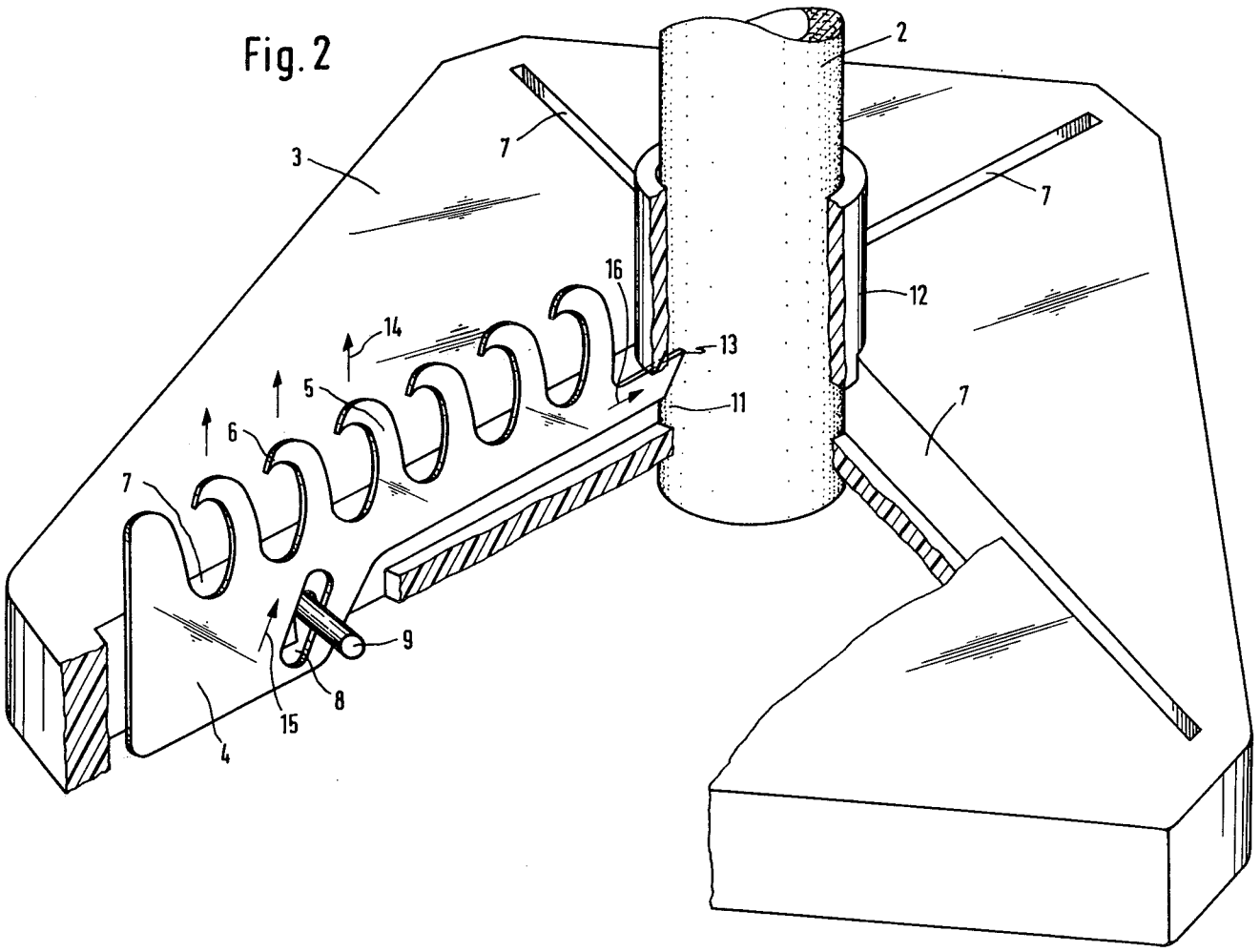
FIG. 2 is an enlarged, partly cut-away, view of a suspension frame of the take-up frame shown in FIG. 1.
Figure 3:
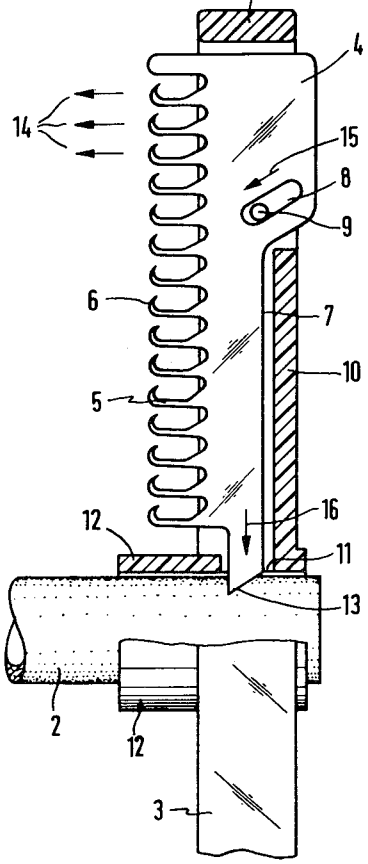
FIG. 3 is an axial partly sectional, view of the suspension frame shown in FIGS. 1 and 2.

As shown in FIGS. 2 and 3, the motion of the hook band 4 is positively controlled by the bolt 9, supported in the suspension frame 3 and engaging in the guide slot 8 at an angle to the shaft 2, and by an opening 11 in a hub 12 on the suspension frame. If a web of material is needled onto the hooks 5, the pull in the web of material is needled onto the hooks 5, the pull in the web of material will thrust the hook band 4 in the direction of the arrow 16 so that the pointed end 13 of the hook band 4 will penetrate the cardboard tube comprising the shaft 2. Notching of the hook band 4 into the shaft 2 is assisted still further by the hook band moving axially in the direction of the arrow 14 simultaneously with the radial motion, such movement being assisted by the guide slot 8 which is inclined in the direction of the arrow 15 towards the shaft 2. A reliable connection between the shaft 2 and the suspension frame 3 is thus established at the beginning of the needling operation without the aid of additional connecting elements.

Figure 4:
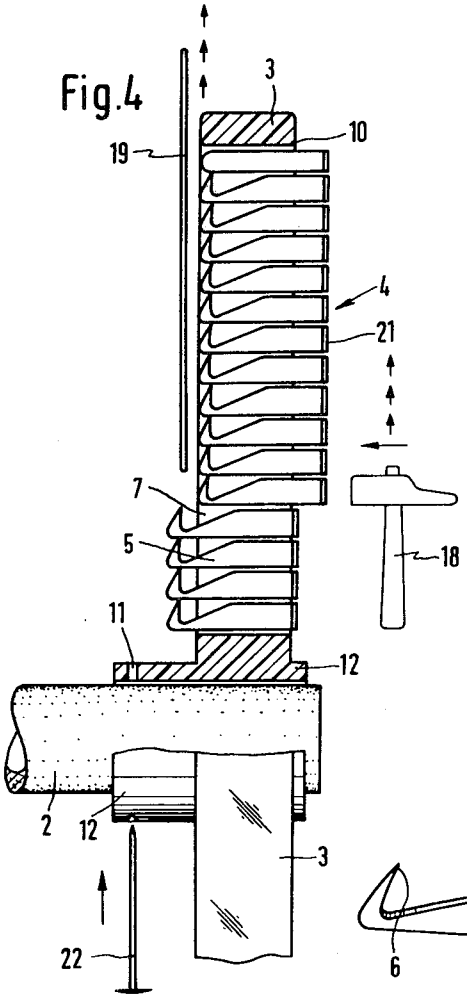
FIG. 4 is an axial, partly sectional view, of a suspension frame with a hook band comprising individual, axially slidable hooks.

The suspension frame 3 shown in FIG. 4 is provided with a slot which extends as far as the hub 12, the hook band which comprises individual hooks 5 joined to each other by means of an adhesive substance being inserted into the slot from the rear side 10 of the suspension frame. As shown in FIG. 4 four hooks 5 have already been set by the hook band 4 into the operating position by the action of impact, symbolized by a hammer 18 at the rear side 10 of the suspension frame, thus enabling the fabric material to be engaged into the uppermost part of each projecting hook 5. Each rotation of the take-up frame 1 causes the next outermost hook 5, in this case the hook 5 nearest the shaft 2, to be thrust towards the opposite suspension frame and to be thus detached from the hook band which is covered by a retaining plate 19 in order to prevent slip, and the retaining plate moves outwardly by the width of one hook after each rotation.

The rear ends 20 of the hooks 5 are bent at 21 so that the rear side 10 of the suspension frame functions as a stop abutment for the bent part 21 to prevent the hooks 5 slipping forward on becoming detached from the hook band 4 and when holding the fabric web. The engaged fabric web prevents the projecting hooks 5 from slipping back. The dimensions of the openings 11 in the hub 12 are such that a nail 22 can be driven through the hub and through the shaft 2 in order to obtain a positive connection between the suspension frame 3 and the shaft 2.

Figure 5:
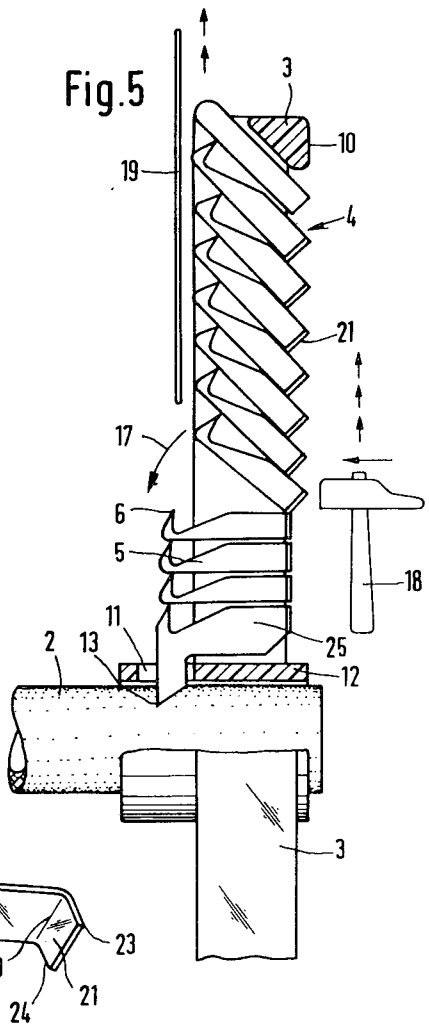
FIG. 5 is an axially, partly sectional, view of a suspension frame with a hook band comprising individual hooks disposed in series at an angle.

FIG. 5 shows a suspension frame 3 in the slot 7 of which is disposed a hook band 4 the hooks 5 of which have the hooked ends 6 pointing outwardly and being arranged in an adjacent series. The bottom edge 23 of the bent part 21 bears on the rear side 10 of the suspension frame. The action of impact, again symbolized by the hammer 18, applied to the top edge 24 of the bent part 21 causes the next hook in this case the fifth hook from the shaft 2, to be pivoted in the direction of the arrow 17 in the horizontal position to take up the fabric webs during the needling operation while the remaining hooks 5, still adhesively joined to each other into a hook band 4 as in the embodiment shown in FIG. 4, are blocked by the retaining plate 19. A connection without connecting means similar to that of the embodiment shown in FIGS. 2 and 3 can be obtained by the pivoting motion of the hooks 5. To this end the hook 25 nearest the shaft 2 is provided with an end 13 which points towards the shaft and which penetrates through a fabric web into the cardboard shaft 2 when the hook 25 is loaded so that the shaft 2 and the suspension frame 3 are positively connected to each other.

The division of the hook bands 4 into individual hooks 5 which can be readily detached from each other, as shown in FIGS. 4 and 5, prevents the tangentially incoming fabric web being spiked by the outwardly disposed hooks 5 because these are initially lowered and are first successively advanced or pivoted outwardly before being hooked into the side edges of the fabric web. This provides for mechanized take-up of fabric webs.

Figure 6:
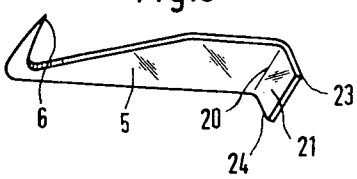
FIG. 6 is a perspective view of a single hook.

The hook 5 shown in FIG. 6 is punched from sheet metal and its rear end 20 has a bent part 21 with top and bottom edges 23 and 24. The hook converges towards the front and extends into an upwardly orientated spiked end 6.

Figure 7:
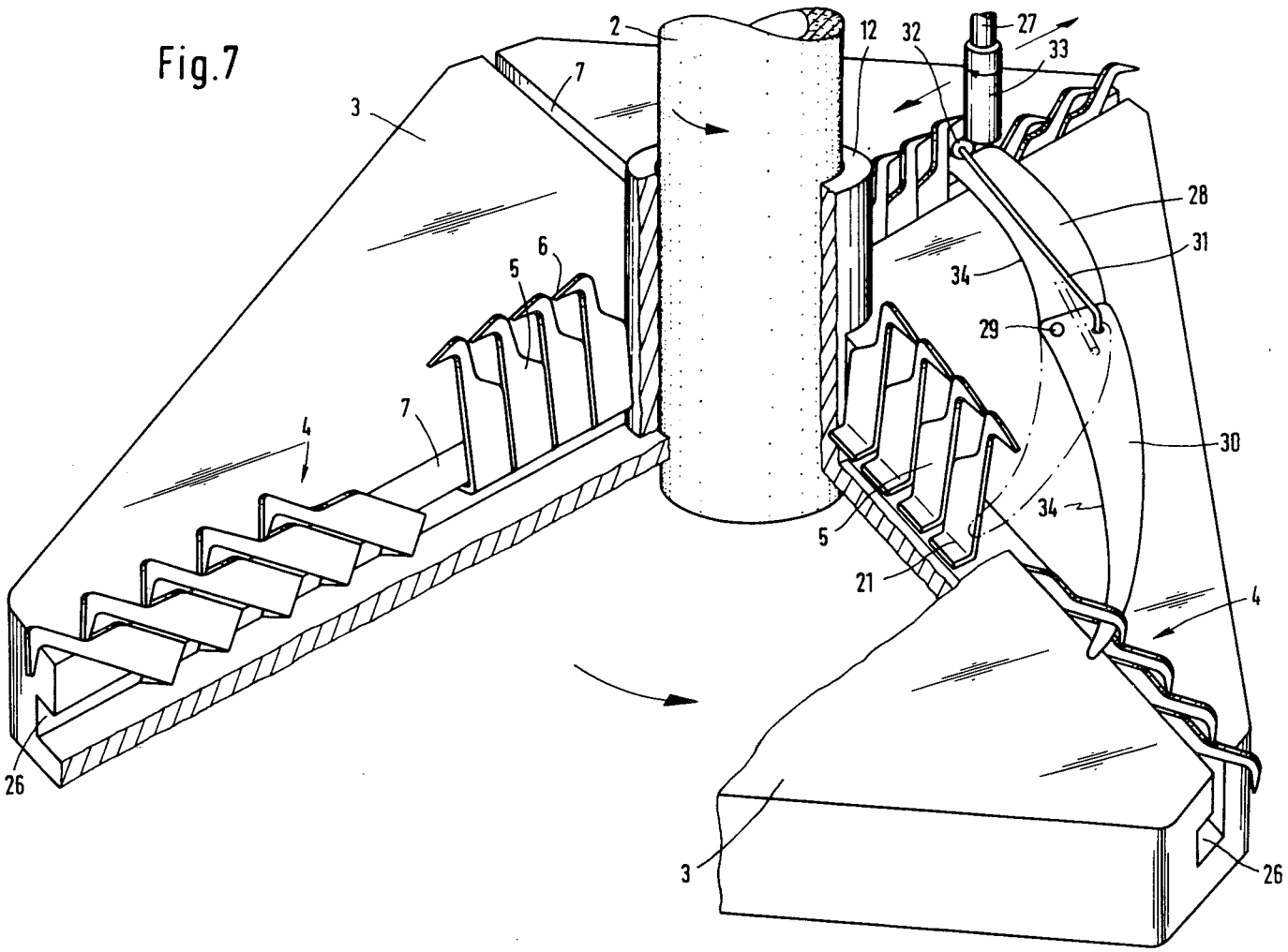
FIG. 7 is an enlarged, partly cut-away, view of the suspension frame shown in FIG. 5 together with a device for outward pivoting of the hooks.

In the slots 7 the suspension frame shown in FIG. 7 for guiding the hook bands 4 are closed at the rear of the suspension frame 3, thus achieving a substantial increase of stability for the suspension frame. The slots 7 have the shape of L-shaped undercut grooves into which the hook bands are inserted from the outside so that the bent parts 21 of the hooks 5 project into the undercut parts 26 of the grooves to prevent the hooks 5 from dropping out. The spiked ends 6 of the hooks 5, which point at an angle to the outside and which are joined to each other, project from the slots 7 to enable a device to act on the hooks 5 for pivoting the latter into the operating position.

A suitable such device comprises a guide plate 28 mounted at the end of a cylindrical rod 27 which is movable in the radial direction, a pivoting finger 30 being pivotably supported on the end 29 of the plate 28. The motions of the finger 30 relative to the guide plate 28 are controlled with a control bar 31 which is jointed by means of a fitting 32 on a shaft 33 which surrounds the cylindrical rod 27. Rotation of the shaft 33 moves the pivoting finger 30 into a position in which it grips under the spiked end 6 of the hook which is inwardly disposed relative thereto but not yet detached from the hook band 4 when the take-up frame 1 is rotated, the hook in this case being that which is the fifth from the shaft 2. Rotation of the shaft 33 pivots the pivoting finger 30 inwardly and thus erects this hook 5. In the course of further rotation of the take-up frame 1, the hook slides along an inner edge 34 of the guide plate 28 and is thus retained in position until the side edges of the fabric web have engaged the hook so that it is unable to slip back. In the meantime rotation of the shaft 33 in the opposite direction has caused the pivoting finger 30 to pivot back in the outward direction to grip under the corresponding hook 5 of the next hook band 4. After each rotation the rod 27 surrounded by the shaft 33 moves radially outwardly by the width of one hook. Fully mechanized take-up of the fabric webs can be achieved at high speeds with this device, which can be mounted on a take-up machine on which take-up frames are mounted for the purpose of winding. The suspension frame shown in FIG. 8 has a hook band 4 comprising individual hooks 5 which are axially slidable. The shaft 2 has a thickened portion 35, constructed of adhesive tape, over which part of the hub 12 is slid so that the suspension frame and the shaft 2 can be firmly clamped to each other.

Figure 9:
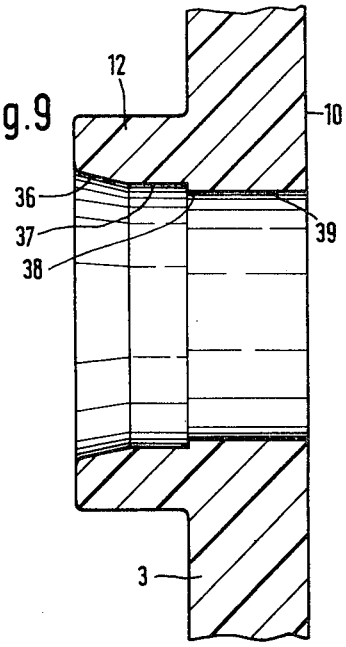
FIG. 9 is an enlarged axial section through the clamping hub shown in FIG. 8.
Figure 10:
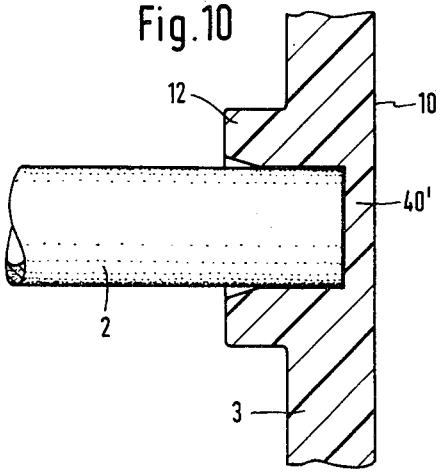
FIGS. 10 and 11 are axial sections through further embodiments of clamping hub.
Figure 11:
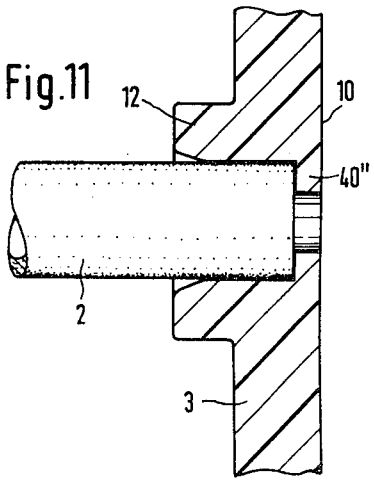

On its left-hand side, nearest to the opposite suspension frame 3 in its mounted state, the hub 12 shown in FIG. 9 has a conical flared portion to enable it to be readily slid over the thickened portion 35. A conically extending part 36 of the hub 12 merges into a cylindrical part, the section 37 of which adjoining the conically extending part is separated by a shouldered edge 38 from a second section 39 of the cylindrical part. The diameter of the second section 39 is less than that of the section 37 and is intended to provide firm guiding and support of the suspension frame 3 on the shaft 2 while the first cylindrical section 37 forms the clamping surface for the thickened portion 35. A clamping connection of this kind can be used as an alternative to or together with the connecting means between the shaft 2 and suspension frame 3 as illustrated in the other figures. FIGS. 10 and 11 show two further embodiments of the hub 12 of the suspension frame 3, and show the left-hand end of the shaft 2 on which the suspension frame 3 is mounted. The hub 12 in FIG. 10 is closed by means of a locking plate 40' on the rear side 10 of the suspension frame 3 to form a blind hole. This prevents the suspension frame 3 slipping further inwardly on the shaft 2. The hub 12 shown in FIG. 11 is provided with a locking web 40'' in place of a locking plate 40' on the rear side 10 of the suspension frame 3 to restrict the free cross-section of the hub 12, thus also preventing the suspension frame 3 slipping towards the inside.

Figure 12:
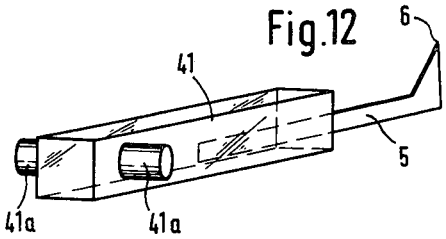
FIG. 12 is a perspective view of another embodiment of a single hook.

The hook 5 shown in FIG. 12 is embedded in a guide member 41 of plastics material, the rear part of which is provided on both sides with cylindrical shaft stubs 41*a*. This hook can be used in place of the hook 5 shown in FIG. 6 for insertion into the slots 7.

Figure 8:
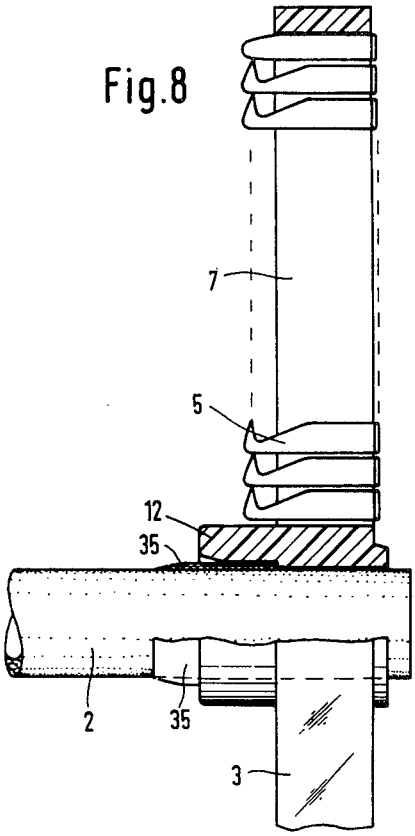
FIG. 8 is an axial, partly sectional, view of the suspension frame shown in FIG. 4 together with a clamping hub.

The take-up frame described above for needling pile fabric combines the advantageous characteristics of the metal suspension frame, namely its sharp-edged spiked hooks, and those of the plastics suspension frame, namely its low weight and versatility with regard to the shapes into which it can be formed. In the embodiments with hook bands comprising individual hooks means for the mechanical take-up fabric webs may be employed whereby substantial savings of time and cost can be obtained. The use of notchable material such as cardboard and appropriately shaped hook bands and/or a clamping connection as shown in FIG. 8 also makes it possible to dispense with connecting elements for connecting the shaft and the suspension frames. The suspension frames are suitable for re-use by sliding in fresh hook bands.

What I claim is:

1. A take-up frame for pile fabric comprising in combination:

two one-piece suspension frames, each having a plurality of radially projecting, narrow, elongated slots formed therein, and each frame having a central hub with a cylindrical bore provided therein;

a cylindrical shaft extending between said frames and having its ends seated in said cylindrical bores, said cylindrical shaft being made of an easily penetrable material such as cardboard and the like;

said central hub having openings through its side in line with each of said slots;

a plurality of hook bands, each having a plurality of hooks projecting from one longitudinal edge thereof, each of said hook bands being slidably disposed within one of the slots in one of said suspension frames, with said hooks projecting from the side of the frame facing toward the other frame;

each of said hook bands having a pointed end that projects through the opening in line with its slot and is adapted to penetrate said cylindrical shaft; and said hook bands being urged longitudinally within said slot in the direction toward the hub by tension of pile fabric attached to said hooks so as to cause said pointed ends to penetrate the cylindrical shaft and thereby lock said suspension frames to the shaft.

2. A take-up frame according to claim 1, wherein each of the radially movable hook bands is provided with a guide slot inclined at an angle to said shaft, and a bolt mounted in the suspension frame and passing through said inclined guide slot, so that when said hook band is pushed in the direction to extend the hooks from the side of the suspension frame, the hook band is caused to move radially inward along its slot.

* * * * *